US007963071B2

(12) United States Patent
Alexander et al.

(10) Patent No.: US 7,963,071 B2
(45) Date of Patent: Jun. 21, 2011

(54) LOUVRE WINDOW SYSTEM

(75) Inventors: Edwin John Alexander, Queensland (AU); Robert Allen, Queensland (AU); John Grimshaw, Queensland (AU); Keith James Chaston, Queensland (AU)

(73) Assignee: Breezway Australia Pty Ltd., Coorparoo, QLD (AU)

( * ) Notice: Subject to any disclaimer, the term of this patent is extended or adjusted under 35 U.S.C. 154(b) by 1239 days.

(21) Appl. No.: 10/495,759

(22) PCT Filed: Nov. 25, 2002

(86) PCT No.: PCT/AU02/01588

§ 371 (c)(1),
(2), (4) Date: Oct. 29, 2004

(87) PCT Pub. No.: WO03/046325

PCT Pub. Date: Jun. 5, 2003

(65) Prior Publication Data

US 2005/0060940 A1 Mar. 24, 2005

(30) Foreign Application Priority Data

Nov. 30, 2001 (AU) ..... PR9212
Jun. 14, 2002 (AU) ..... PS2964

(51) Int. Cl.
*E06B 7/00* (2006.01)

(52) U.S. Cl. ..... 49/403; 49/74.1; 49/82.1

(58) Field of Classification Search ..... 49/74.1, 49/403, 82.1, 92.1
See application file for complete search history.

(56) References Cited

U.S. PATENT DOCUMENTS

| | | | | |
|---|---|---|---|---|
| 1,830,487 | A | 5/1929 | Samberg | |
| 3,954,023 | A * | 5/1976 | Perez-Aguilar | 74/533 |
| 4,226,051 | A | 10/1980 | Thompson | |
| 4,310,993 | A | 1/1982 | White | |
| 5,560,147 | A * | 10/1996 | Ashida et al. | 49/74.1 |
| 7,104,010 | B2 * | 9/2006 | Winner | 49/403 |
| 2006/0179721 | A1 * | 8/2006 | Tan | 49/403 |

FOREIGN PATENT DOCUMENTS

| | | |
|---|---|---|
| AU | A-23966/88 | 4/1989 |
| EP | 0 432 828 A1 | 6/1991 |
| EP | 0 785 335 B1 | 7/1997 |
| JP | 11325529 A | 11/1999 |
| JP | 2002-034347 | 2/2002 |

* cited by examiner

*Primary Examiner* — Jerry Redman
(74) *Attorney, Agent, or Firm* — Stein McEwen, LLP

(57) ABSTRACT

A louvre window system has an end clip (10) which is formed with at least one internal drainage channel (14) which can drain water through the end clip (10). A number of such clips can rotate between an open position and a closed position. The clips (10) are aligned when in the closed position which insures that water can drain from an upper clip through a lower clip. The clips (10) have a low friction design which enables a larger number of louvers to be rotated by a single handle (55) without placing too much load on the handle and on the louvre operating mechanism. A simple efficient louver operating mechanism (27; 37) is used to operate the end clips.

17 Claims, 16 Drawing Sheets

LOUVRE WINDOW SYSTEM

FIELD OF THE INVENTION

This invention is related to a louvre system for louvre windows, and particularly for louvre windows comprising glass, metal, timber, plastic blades etc, and comprises a plurality of improvements to existing louvre systems, these improvements being directed to improvements to reducing water penetration and to drain water from a louvre window, and improvements to the louvre operating system by which louvre blades can be opened and closed together. Other improvements to the louvre system will also become apparent.

BACKGROUND ART

Louvre windows consist of a surround frame formed of upper and lower horizontal frame portions and opposed side frame portions which are fastened together. The frame supports an array of horizontal louvres which pivot about horizontal pivot pins between louvre open and louvre closed positions. It is known to tip the frame on its side such that the louvres extend vertically, however the invention will be described with respect to horizontally extending louvre blades.

For louvre windows, the blades are typically formed of glass (but can be made of other material) and are rectangular when viewed in plan. The blades can have a length of anywhere between 20 to 120 cm, a width of between 10 to 40 cm, and a thickness of between 4 to 20 mm.

As it is not practical to drill holes in glass blades, it is usual for the blades to be supported by end clips. One end clip is pivotally attached to one side frame portion and the other end clip is pivotally attached to the other side frame portion. It is normal for the end clips on one side frame portion to be functionally attached together such that all the end clips can be rotated by a louvre operating mechanism. The end clips on the other side frame portion can usually pivot independently.

In order to reduce water penetration through the louvre window, the blades are in an overlapping configuration when closed, which means that a lower longitudinal edge of an upper blade overlaps the upper longitudinal edge of an adjacent lower blade. It is also known to have end clips configured to seal against each other to minimise water penetration through the end clips. The configuration of the end clip includes a longitudinal rib which seals against the U-shaped aluminium channel as the end clip pivots from the open position to the closed position.

Notwithstanding many attempts to redesign the end clip, water still penetrates through the join between one end clip and a second end clip when the clips are in the closed position. This is exacerbated when there is also a pressure differential between the front of the louvre and the rear of the louvre. A pressure differential often occurs during sudden storms where the pressure inside the room can be appreciably lower than the outside pressure resulting in an air/water mixture being forced between the end clips when the louvres are in the closed position.

Overlapping blades are not very effective in preventing water penetration. Under strong wind and rain conditions, water can be forced uphill between the overlapping closed blades and into the interior of the louvre window. One way to minimise this is to increase the degree of overlap but this increases the size and weight of a louvre window and reduces optical transparency.

One form of the present invention is to provide a redesigned end clip which now has at least one drainage channel to drain water which may pass between one end clip and another end clip. Suitably, a number of drainage channels are provided to greatly reduce the possibility of water penetrating entirely through the end clips.

Conventional louvre operating mechanisms rotate the end clips on one side frame portion by engaging with and rotating the pivot pins. The mechanism is simple as the louvre pivots about a central portion which means that the pivot pin is easily accessible to the mechanism.

A particular disadvantage with conventional louvre mechanisms is the rather large load placed on the operating mechanism when opening or closing a louvre window of the type described above. This requires components to be made of strong material, usually steel which adds to the manufacturing cost. As well, it can be difficult for a person to manipulate a conventional operating mechanism due to the larger loads.

The main reason for the relatively large load being placed on operating mechanism is due to the end clip frictionally engaging with the U-shaped channel as the end clip moves either from the closed position to the open position or from the open position to the closed position. The reason for this is that the end clip is provided with a longitudinal sealing rib or bead which wipes across the U-shaped channel as the clip rotates to the closed position, or away from the closed position. This wiping action places a load on the operating system, and therefore a restriction is placed on the number of louvre blades which can be rotated by a single operating system, typically to about six blades.

It would be an advantage to rotate more blades using a single handle without jeopardising or reducing the sealing action of the end clip. The reason why it would be an advantage is in being able to align the handles horizontally when a number of separate louvre windows are positioned in a single room. That is, if a room contains, say, 3 banks of louvre windows, it is aesthetically pleasing if the handles could all be at the same distance either from the ground or from the ceiling (that is aligned horizontally). Furthermore, If a handle could operate a large number of blades without damaging or destroying the operating mechanism, greater versatility would be present in placement of the handles, not only for aesthetic appeal, but also to allow mobility impaired persons (such as wheelchair persons) to operate a louvre window where are otherwise the handle may be placed in a position which is too high (or too low) for easy access by the mobility impaired person.

However it is not possible to simply remove the sealing rib on the end clip in order to reduce the load placed on the operating system, as this will now reduce the weatherproofing of the entire louvre window.

It is known to open larger louvre structures using assistance from pneumatic rams, but this requires pressure piping to be installed around the frame and greatly adds to the cost. Large helical springs have also been used to assist in movement of larger louvres (typically steel or metal louvres) for fire ventilation.

Various types of louvre actuating devices are known to open and close the louvre blades. A typical and very common louvre operating mechanism comprises a pair of flat metal rods which are positioned within the U-shaped channel. The louvre end clip is attached to the bearing. The bearing has a rear face containing two spaced apart stubby pins. One metal rod is attached to one of the pins and the other metal rod is attached to the other pin. The rods reciprocate in opposite directions and are controlled by an external handle. Movement of the handle either upwardly or downwardly causes one of the rods to move one way and the other rod to move the other way which in turn rotates the bearing and therefore the end clip and therefore the louvre between the closed and the open positions. The pair of flat metal rods connects between 4-6 end clips to rotate together upon operation of the handle.

With this system, the short stubby pins which are attached to the bars exhibit quite strong forces upon operation of the louvre operating mechanism. Importantly, these pins exhibit a bending force as well as a shear force. While the pins are typically strong enough to withstand the shear forces, it is found that most failure of the louvre operating mechanism occurs when the pins break due to the bending force. Therefore, it would be an advantage if it was possible to develop a louvre operating mechanism which would place less bending force on the pins.

Another disadvantage with this conventional system is the requirement to process and assemble two bars into the U-shaped channel as part of the manufacture of the operating system. The heads of the pins need to be permanently deformed to hold the bars in position. This requires specialised assembly equipment, and once the operating system is assembled no part of the assembly can be readily replaced. Therefore, if, say, one of the pins is damaged, it is necessary to remove the entire louvre operating system and to replace it. This is quite expensive and laborious.

It is known to provide a louvre operating mechanism which has only a single bar. This provides certain advantages over the assembly described above. Typically, the single bar is a rack and pinion system where the bar is provided with a rack (a type of tooth structure), and the bearing (to which the end clip is attached) is provided with some sort of pinion arrangement. It is essential that the teeth on the rack and the teeth on the pinion are formed in the correct shape which requires both to be moulded components. The bar containing the rack is formed into smaller sections which are joined together such that the required number of blades can be operated with a single handle. It is extremely important that the spacing between the racks on the bar is exactly correct, otherwise operation of the handle will result in louvre blades closing or opening in a nonuniform manner. For instance, one louvre blade could be in the fully closed position while an adjacent louvre blade is in the almost closed position and this is certainly undesirable. Therefore, the manufacture and the assembly of this type of louvre operating system is expensive and requires extreme accuracy.

The large majority of louvre systems manufactured in the world today rely on a simple handle and link systems to operate the louvre mechanism (open and close the louvre blades). This simple handle/link also provides complete and positive closure of the window by means of the handle/link joint being forced over-centre via an intuitive action of pushing the handle into a closed position.

The handle/link joint is constructed using a purpose made rivet or stud with the link being attached to either the top or bottom face of the handle. The method of attaching the link to one face of the handle via a rivet results in flexing of this joint when locking—over centre closing)—pressure is applied to the system (tests have confirmed that there is a correlation between locking pressure, blade to blade contact, and water penetration resistance). Because one member is placed on top of the other member and then joined together via a rivet, the acting/reacting forces are not in alignment with each other which introduces a bending moment at the joint, which in turn results in flexing of the joint. This flexing of the joint ultimately results in failure of the joint (the most common failure being that the rivet either breaks, or pulls out of the link).

It would be an advantage if it were possible to minimise or eliminate this disadvantage.

Australian patent application 23966/88 is directed to a louvre clip assembly. The assembly has a louvre clip containing internal voids. The voids are weight reducing voids and do not appear to be used for any draining reason.

Australian patent application 23297/95 describes a louvre system containing last louvres and metal louvres. The lower end of the metal louvre is curved to form a gutter. The gutter drains water from the louvre into the vertical side jamb, which is provided with a drainage hole to drain water to the bottom and to the outside of the jamb. The louvre end clips to not contain any drainage channels.

U.S. Pat. No. 4,226,051 is directed to a louvre window. The louvre glass is fitted into an end clip which contains a reinforcing element which forms an enclosed void. This void does not appear to be used for drainage.

European patent application 432828 describes an end clip and particularly a moulded end clip which has a substantially hollow interior. The interior does not appear to be used to drain water.

U.S. Pat. No. 1,830,487 shows a louvre for windows and FIG. 6 appears to show a small internal void but this void does not appear to be used to drain water.

U.S. Pat. No. 4,310,993 describes a gutter arrangements and a down spout arrangement but the arrangement does not form part of an end clip.

Japanese patent application 11325529 does not appear to show an end clip containing internal drainage channels.

OBJECT OF THE INVENTION

It is an object of the invention to provide a louvre system containing various improvements and which may overcome at least some of the abovementioned disadvantages.

In one form, the invention resides in a louvre end clip, the end clip having an outer body, a longitudinal recess formed in the outer body and which is adapted to accommodate the edge of a louvre blade, the outer body having at least one internal drainage chamber which allows water to drain through the end clip when the end clip is in the closed position.

Previous end clips failed to provide internal drainage chambers which meant that if water did penetrate between end clips, it would simply run over the outside of the end clip and hopefully into a lower collection channel on the bottom of the louvre window. However, this is quite unsightly and often water drips off the end clips and lands on the floor rather than passing down the various louvre blades and into the collection channel on the bottom of the louvre window. The internal drainage chamber can be seen as a water collection chamber.

Suitably, the at least one drainage or collection chamber has an open bottom and forms a closed chamber with the U-shaped channel to which the end clip is attached when the clip is in the closed position. This reduces the weight of the end clip and can also reduce the load placed on the louvre operating system by not having a closed bottom wall that may frictionally rub against the U-shaped section. However, if an entirely closed chamber is considered desirable it will form part of the present invention.

Suitably, the at least one chamber has an at least partially open top end and an at least partially open bottom end. Thus, when a number of end clips are all in the closed position and in line with each other, the chamber on each end clip can communicate with the chamber on each adjacent end clip to form a single drainage channel to allow water to quickly and unobtrusively drain into the collecting channel or some other form of channel/drainage means on the lower part of the louvre frame.

Suitably, the at least one chamber extends between the longitudinal recess which accommodate the louvre blade, and an outer edge of the end clip.

It is preferred that the at least one chamber has a curved outer wall and therefore may comprise a curved outer wall extending between the longitudinal recess and the free edge of the end clip. It is preferred that the outer wall is uniformly curved.

It is preferred that the at least one chamber has one wall which is defined by a wall which comprises the longitudinal recess.

In use, any water which penetrates between adjacent closed end clips will pass into the at least one chamber. In this area, there will typically be a change of pressure and velocity conditions and this typically results in water droplets becoming more easily separated from the air and dropping into and along the at least one chamber to be drained away.

Suitably, the end clip is provided with more than one drainage chamber. Thus, a second drainage chamber may be provided. The second drainage chamber may comprise the longitudinal recess and more preferably may comprise a gap formed between the louvre blade that is positioned within the longitudinal recess and the bottom wall of the longitudinal recess.

If necessary, a spacing means may be provided to ensure that the louvre blade is not pushed all the way into the longitudinal recess such that a gap is no longer formed. The spacing means may comprise a projection or a plurality of projections, a rib, and the like. The spacing means may be sufficient to ensure that there is a gap of least 1-8 mm.

The end clip suitably has a third drainage chamber. The third drainage chamber may be similar to the at least one chamber but on the other side of the clip.

Thus, a preferred end clip can be provided with 3 drainage chambers/zones/areas being an outer chamber (the at least one chamber) an intermediate chamber (in the longitudinal recess), and an inner chamber (the third drainage chamber which is on the other side of the longitudinal recess).

It is preferred that the at least one chamber and the third inner chamber have a curved outer wall, and therefore in another form the invention resides in an end clip for a louvre, the end clip comprising a longitudinal body, the longitudinal body being substantially semicircular in cross-section, and having a longitudinal recess into which a louvre blade can fit.

Another advantage with the above clip configuration is that when the clips are all in the closed position, a substantially continuous line is produced which provides better drainage and weatherproofing.

If desired, a shroud can be provided. The shroud may comprise an extending lip that extends over an adjacent clip when the two clips are in the closed position and to provide further weatherproofing. The shroud may be formed integrally with the clip. The length of the shroud has an effect on the weatherproofing of the clips, however if the shroud is too long, the shroud may be damaged and manufacturing costs are increased. After much research and experimentation it has been found that the shroud length is dependent on the gap width between adjacent clips, and a ratio of shroud length to gap width should be between 5-6. Thus, if the gap width is approximately 1 mm, the shroud length should be between 5 mm-6 mm.

In order to allow a single handle to manipulate a larger than normal number of louvre blades, and in order to avoid manufacture of extremely heavy duty and expensive louvre operating systems, the present invention is also directed to an arrangement where the load on the operating system can be reduced which thereby allows a handle to operate a larger than normal number of louvres blades.

One form of the present invention allows this to happen by ensuring that the clip does not frictionally engage or rub up along the U-shaped section until just before the clip is pivoted to the fully closed position at which time a seal is formed. Thus, once the clip has been only slightly opened, the sealing engagement between the clip and the channel is typically lost which means that there is much less load placed on the louvre operating system upon further operation of the end clip.

In one form this can be achieved by providing an assembly of an end clip, a bearing and a channel member, the end clip being pivotally attached to the channel member to enable the end clip to be rotated between a closed position where the end clip is substantially in line with the channel member, and an open position where the end clip pivots to an angle relative to the channel member, the bearing being attached to the end clip such that rotation of the bearing causes the end clip to rotate, the bearing having a portion which is positioned in the channel member, this portion being provided with a first camming member, the channel member being provided with camming surface, the position of the camming member and the second camming surface being such that a seal is obtained only when the bearing member is rotated to the louvre closed position, but when the bearing member is rotated to a partially louvre opening position, the seal is lost.

Thus, the end clip can now be rotatably attached to the channel member quite loosely by which is meant that the end clip does not frictionally rub up across the channel member for most of the time that the end clip moves between opened in closed positions. Only when the end clip is in the almost closed position does the cam engage to pull the end clip against the channel member to provide a good seal. Slight opening of the end clip will release the cam thereby allowing the end clips to again move with little frictional load against the channel member.

It is envisaged that there will be many different types of camming actions or pulling actions to pull the end clip against the channel member when the end clip is in the almost closed position, and it is considered that the invention should not be limited to just one type of cam arrangement.

Thus, in a broader form of this invention there may be provided an assembly comprising an end clip, a bearing to which the end clip is attached, a channel member to which the bearing is attached, the bearing being rotatable relative to the channel member, the bearing or channel member being provided with a cam arrangement such that when the end clip is in the almost closed position, the end clip is pulled against the channel member to provide a seal.

The end clip can now be attached such that there is a gap between the end clip and channel member (thereby reducing frictional engagement), and although this in theory could allow water to more easily pass through the end clip, as soon as the end clip is rotated to the closed position, it is pulled against the channel member to provide a good seal thereto.

The camming device can be spring-loaded so that any tolerance issues are negated.

For the majority of the open/close cycle, the cam is not functioning with the results that there is negligible contact between the clip and the channel. This minimises load on the operating mechanism. This allows a greater number of blades to be operated with the one handle. This enables the handles to be positioned in a more ergonomically sound position.

The cam functions to pull the end clip to the face of the channel member. Another advantage with this is any visible light between the end clip and channel is eliminated. This can improve the aesthetics and the perception of weatherproofing.

It is preferred that the end clip comprises a concave bow over its length. This is done such that the pulling down of the clip onto the channel by the cam will result in the clip being called into contact with the channel over the full length of the clip.

In a further form of the invention there is provided an improved louvre operating system. This operating system requires only a single bar (which is already known), but the bar has a particular shape and is held in a particular manner that provide significant benefits.

Therefore, another form of the invention is directed to a louvre operating system which comprises an elongate operating bar, the bar being substantially L-shaped to define 2 elongate legs which are substantially at right angles to each other, one leg being provided with a plurality of sprocket tooth forms spaced along the leg.

With this arrangement, the tooth form is can be punched into one leg of the L section bar, with the other leg providing sufficient strength to the bar. If the bar was simply flat, the tooth form might weaken the bar which means that the bar might have to be formed of stronger and more expensive material.

Preferably, a single operating bar is used to rotate all the louvre blades. Thus, it is no longer necessary to manufacture operating bars in smaller links and connect the bars together that possesses a number of disadvantages described above. Also, punching the tooth form into one leg of the bar is a relatively simple operation to carry out and the pitching accuracy is easy to achieve and maintain as this can be built into the tool.

The louvre operating assembly may comprise the elongate bar as described above, and a bearing which is attached to an end clip, the bearing being provided with a tooth profile which can engage with the tooth form on the operating bar such that reciprocation of the operating bar will cause rotation of the bearing. Suitably, the operating bar contains a plurality of such forms, and may have between 2-15 tooth forms on a single operating bar. This can engage with approximately 2-15 bearings that allow 2-15 louvre blades to be operated by a single handle.

The handle may be connected to a link that is contained in a slot in the handle at the joint between link and handle. This enables the rivet to be supported (or fixed) to both sides of the slot in the handle. This minimizes any bending forces on the rivet, increases the strength of the joint (for components of the same size made from the same material); and eliminates any flexing of the joint under locking pressure as there is no component of the force at the joint acting perpendicular to acting/reacting forces at the handle/link joint.

BRIEF DESCRIPTION OF THE DRAWINGS

Embodiments of the invention will be described with reference to the following drawings in which.

BEST MODE

Figure 1:
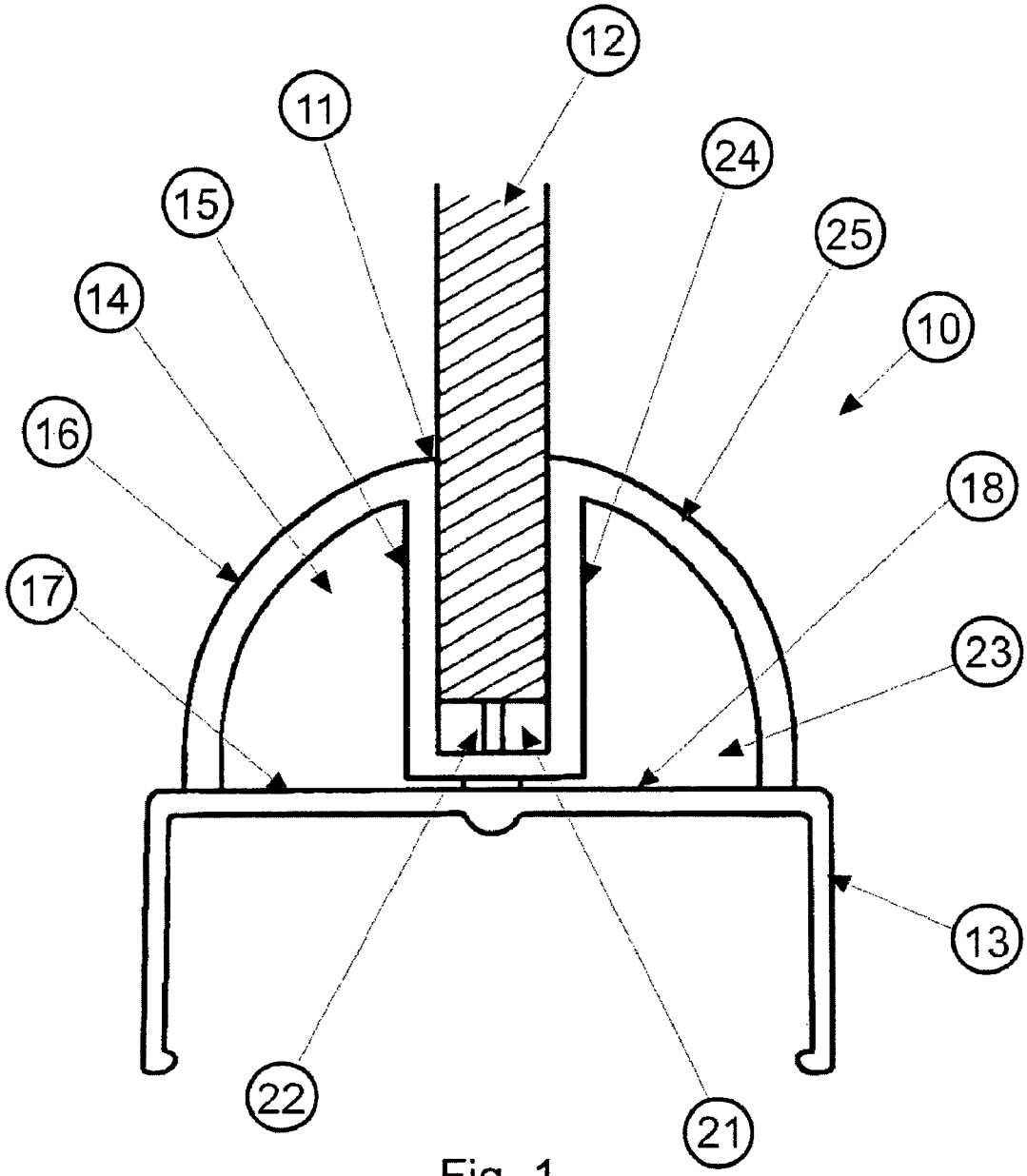
FIG. 1. illustrates a section view of a louvre blade fitted within an end clip that is in the closed position on the channel member, the section taken along Line A-A illustrated in FIG. 18 above the bearing.

Referring to the drawings and initially to FIG. 1 there is illustrated in section view a louvre end clip 10 which is generally semicircular in configuration and contains a longitudinal recess 11 into which the edge of a louvre blade (typically a glass louvre blade) 12 can fit. End clip 10 is positioned on a channel member 13, which is typically an extruded U-shaped channel member, the channel member per se being known.

End clip 10 has a unique curved configuration and contains at least one drainage chamber 14. Drainage chamber 14 is defined by one sidewall 15 of recess 11, and the curved outer wall 16 of end clip 10. The end clip has an open bottom 17, but when the end clip is in the closed position illustrated in FIG. 1, the outer wall 18 closes chamber 14. Of course, when the end clip is pivoted to the open position, chamber 14 is now open at the bottom 17.

Figure 8:
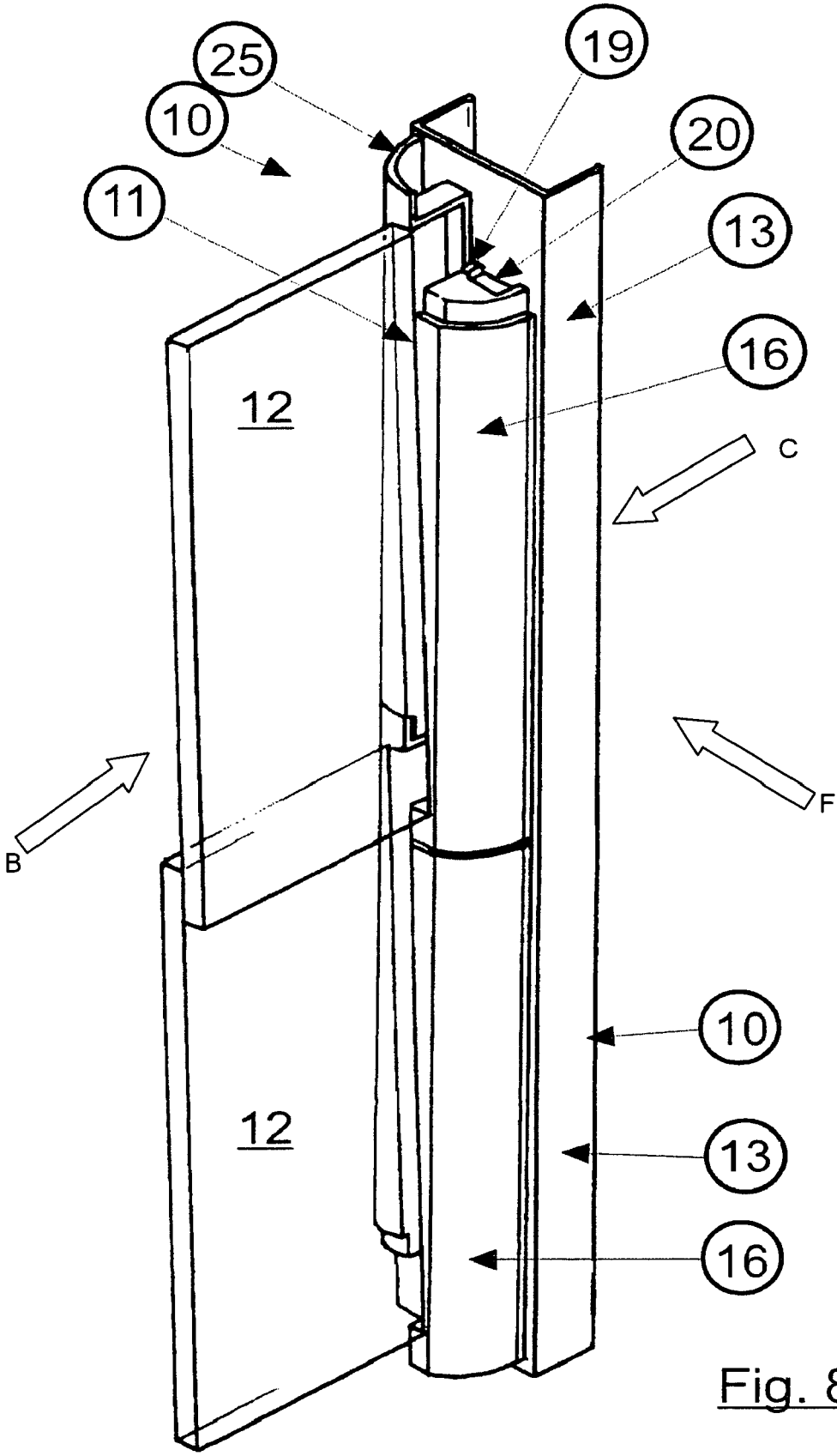
FIG. 8. illustrates a side view of a general assembly according to a preferred embodiment of the present invention with a generic pair of end clips attached to a generic channel member and in the closed position, each end clip having a generic, louvre blade attached and without a handle mechanism.
Figure 9:
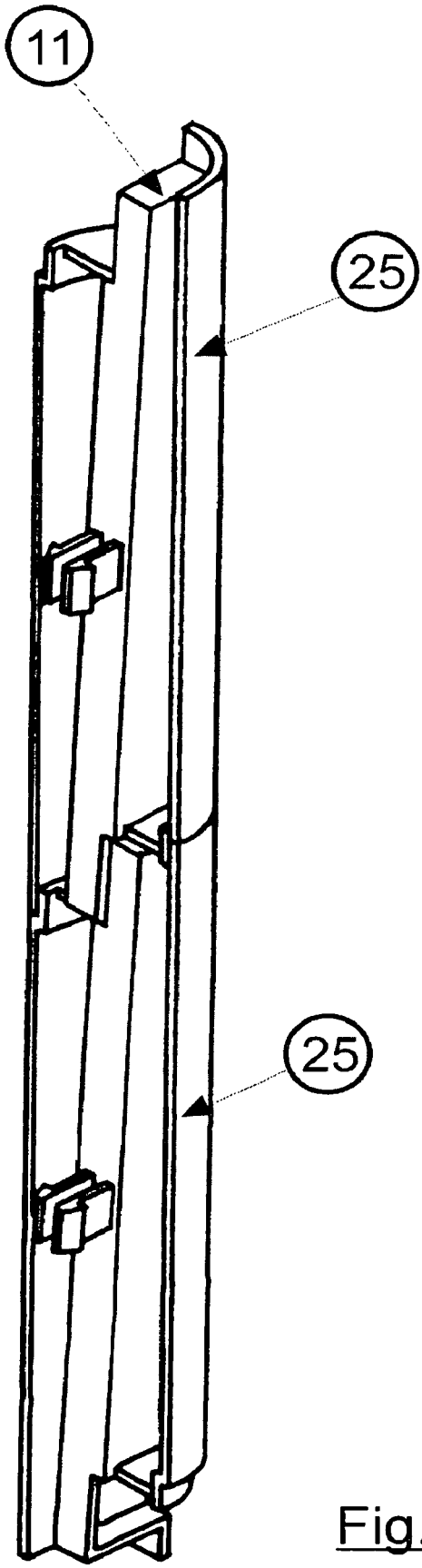
FIG. 9. illustrates the end clips of FIG. 8 from the direction of arrow C in FIG. 8, with the channel member and louver blades removed.

Chamber 14 extends along the length of louvre clip 10, and this is better illustrated in FIGS. 8 and 9. Chamber 14 has two end faces 19, 20 (only end face 19 being illustrated in FIG. 8). Each end face is formed with an opening 20 to allow water to pass into and down chamber 14.

Testing reveals that one of the main areas where water penetrates the system is at the intersection between adjacent clips. Because the louvre system functions by adjacent overlapping blades a gap is formed between adjacent end clips. Normal manufacturing tolerances makes it virtually impossible to eliminate the gap. Under a situation where there is a pressure differential between the inside and the outside of a louvre window, air infiltrates and water tracks through the gap between overlapping clips and enters the inside of the system.

With the clip design that forms part of the present invention, any air/water mixture that passes between the clips initially contacts the upper end of chamber 14, which has opening 20. The physical geometry in this area is that the "air gap" greatly increases between the narrower gap between the clips and the quite large opening into chamber 14. This increase in volume reduces the velocity and the pressure of the air/water. The result is what can be seen as a reducing vortex that "dumps" water from the air stream, the water then passing or dropping into chamber 14.

The end clip of the embodiment has a second drainage chamber 21. The second drainage chamber can be seen as an intermediate drainage chamber and is defined by the lowermost portion 21 of recess 11, this being best illustrated in FIG. 1. This lowermost portion exists between the bottom of blade 12 and the bottom wall of recess 11. Although this chamber is not as large as chamber 14, it nevertheless does function to drain water. To prevent blade 12 from being pushed up against the bottom wall of recess 11, a small spacing member 22 is provided to ensure that chamber 21 exists.

The end clip finally has a third chamber 23. Third chamber 23 in the embodiment is identical in size and configuration to chamber 14 except that it extends on the other side of blade 11. Chamber 23 is defined by one sidewall 24 of recess 11 and curved outer wall 25 of end clip 10. The third chamber 23 functions as a backup to drain any water that may pass over chamber 14 and chamber 21.

Thus, end clip 10 in the embodiment has 3 drainage chambers providing an extremely effective drainage of water passing between the clips.

The shape of the end clip is such that when a number of end clips are in the closed position (see FIG. 8 illustrating 2 end clips in the closed position) the outside curved side wall is virtually a single continuous curved side wall which provides improved drainage and improved aesthetic appeal and allows for easier cleaning.

Figure 2:
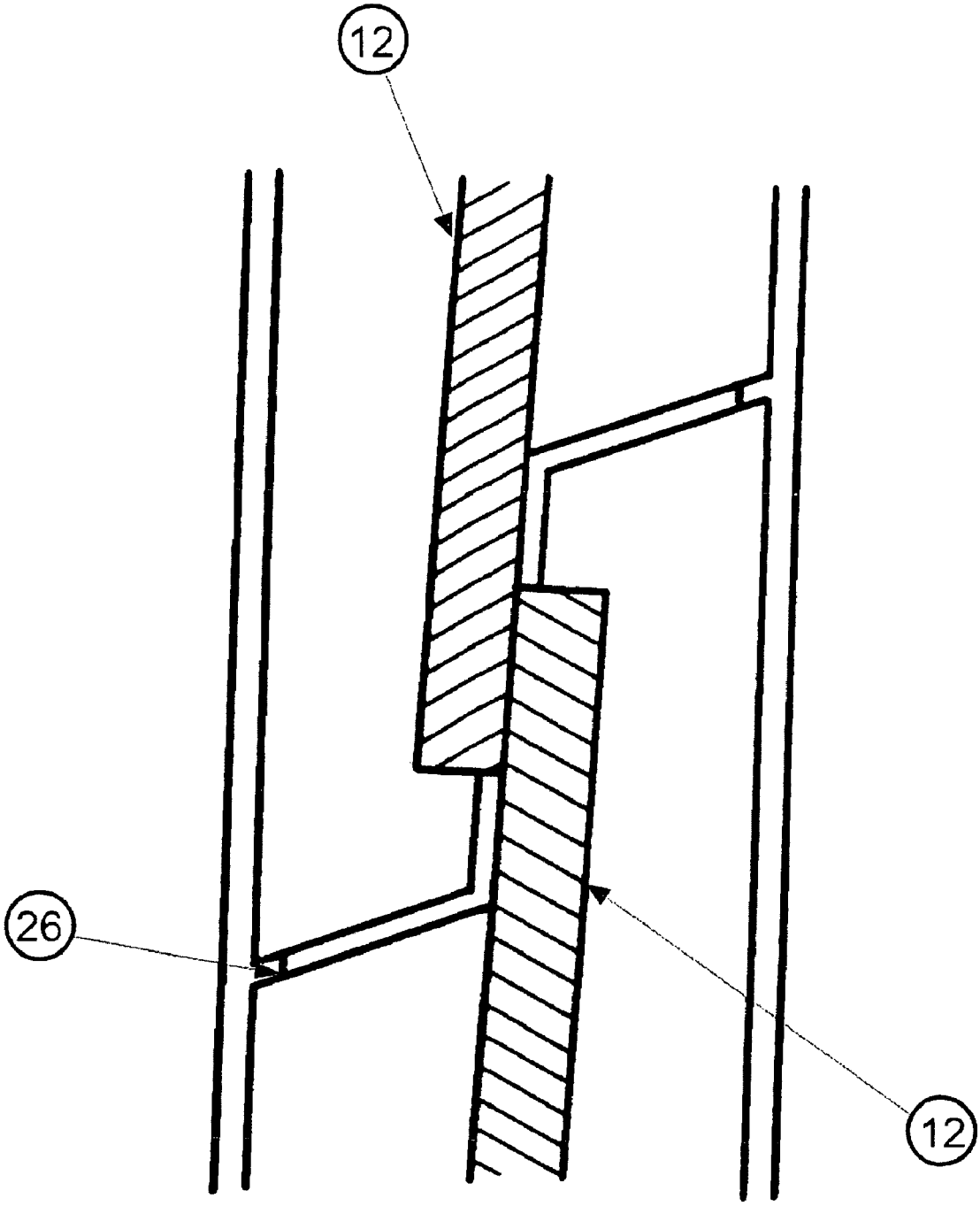
FIG. 2. illustrates a side view of a pair of louvre clips in the closed position, each clip having a louvre blade fitted.

FIG. 2 illustrates the gap 26 between two adjacent end clips and through which air/water can pass.

Figure 3:
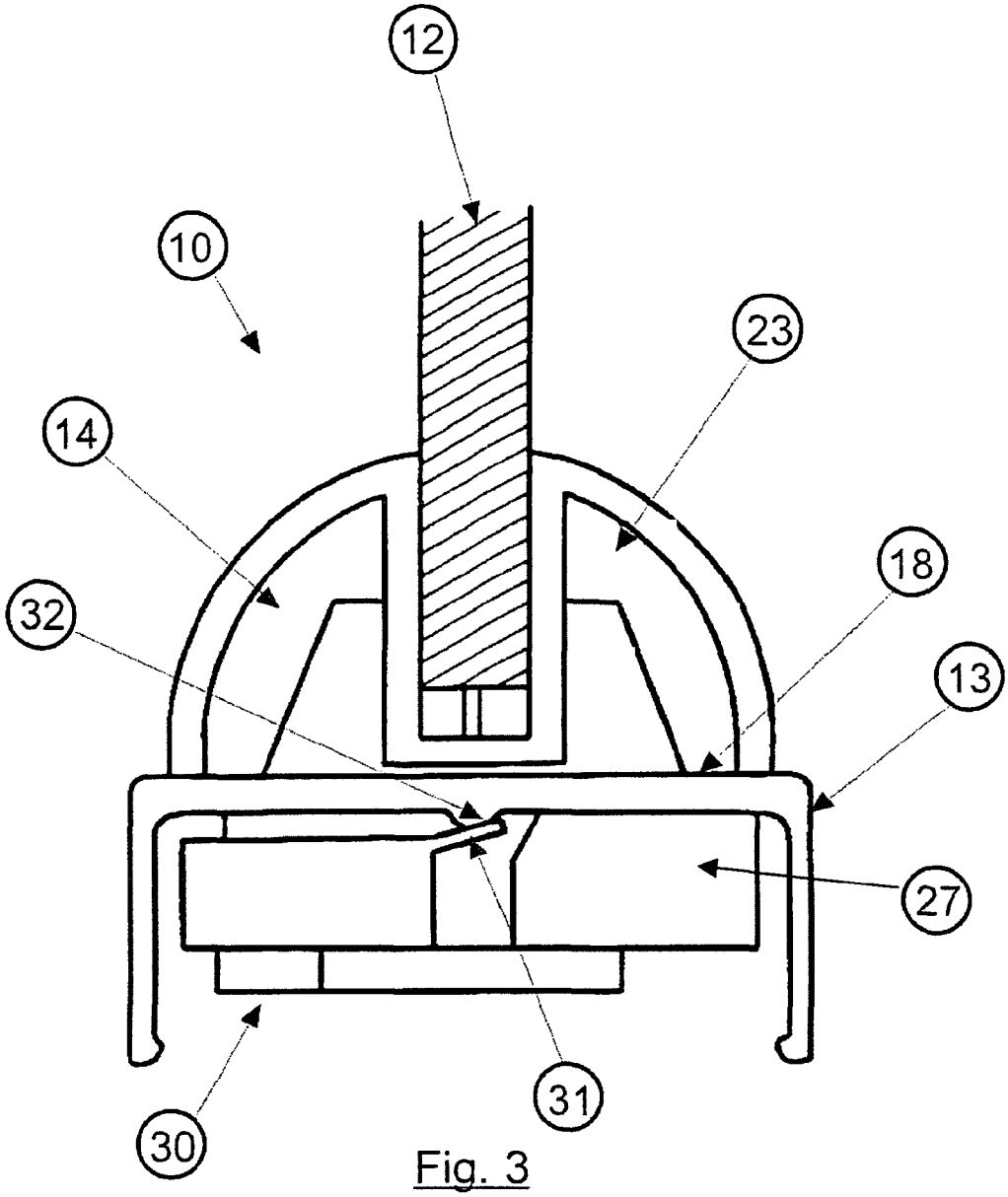
FIG. 3. illustrates a section view taken along Line D-D illustrated in FIG. 18 through the bearing illustrating the cam arrangement according to a first embodiment where the end clip is pulled against the channel member by a cam.
Figure 4:
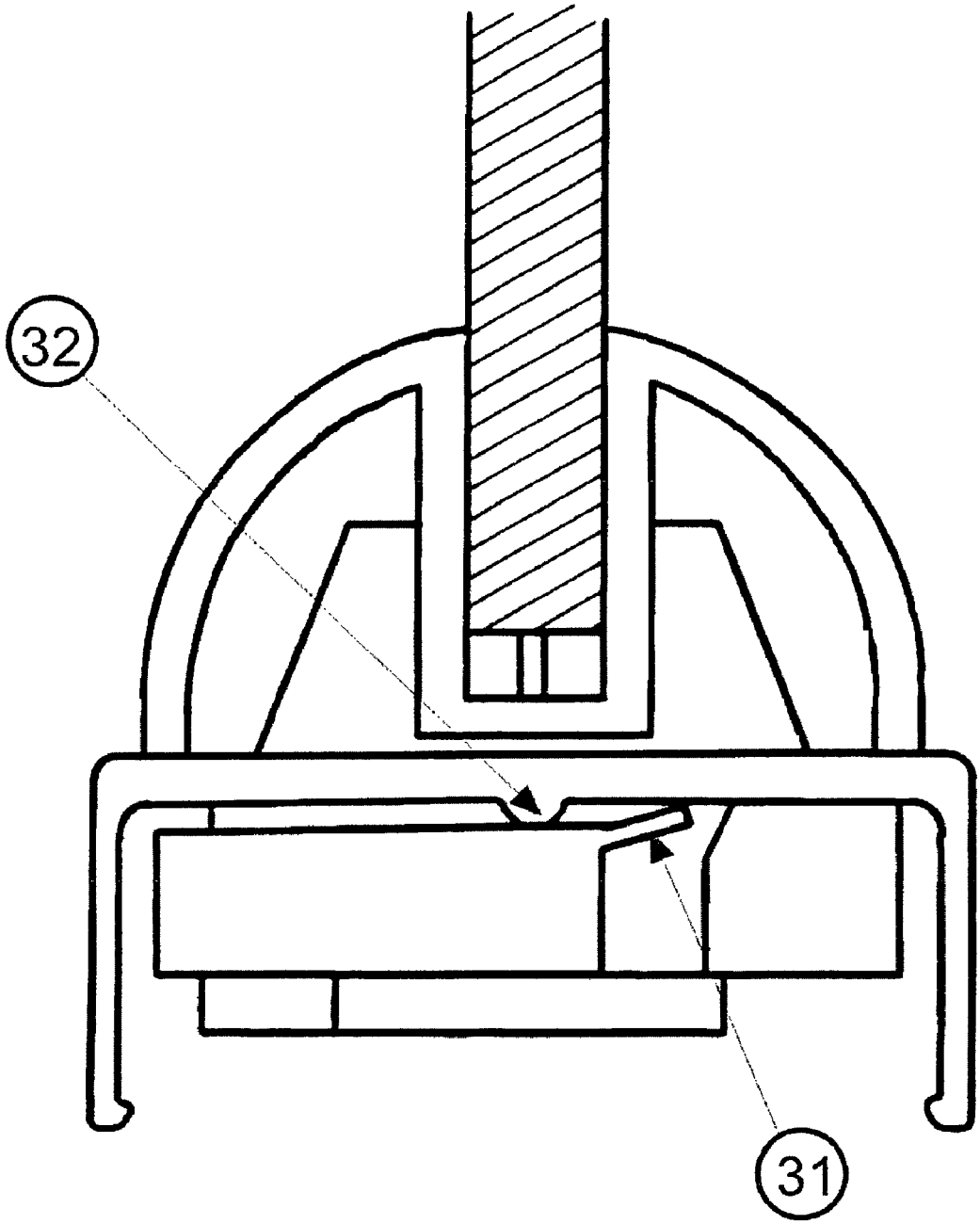
FIG. 4. illustrates a section view taken along line D-D illustrated in FIG. 18 showing the cam arrangement of FIG. 3 but now in the free position.

FIGS. 3 and 4 illustrate another part of the invention that is the cam arrangement. Previously, in order to ensure that end clip 10 was properly sealed against channel member 13 when in the closed position, it was necessary for the inner wall of the end clip to have some form of longitudinal sealing rib which pressed against outer wall 18 of channel member 13. However, this increased the force required to operate each end clip and placed a limitation on the number of louvres which could be operated by a single operating mechanism and by a single handle.

Figure 6:
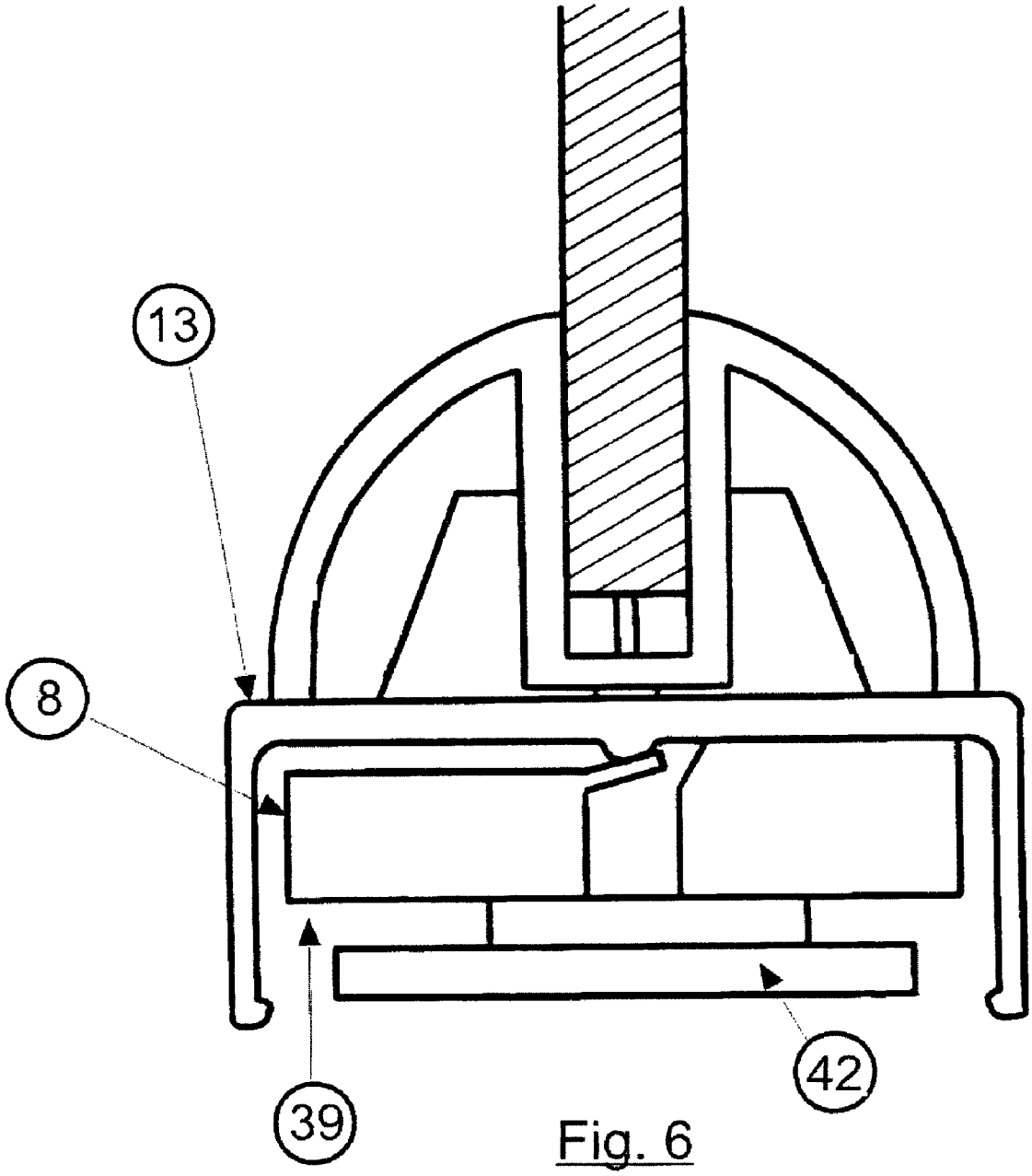
FIG. 6. illustrates in section along the line D-D illustrated in FIGS. 18 and 19, through the bearing illustrating a second embodiment of the bearing member with a snap on cap spaced from the bearing member.
Figure 7:
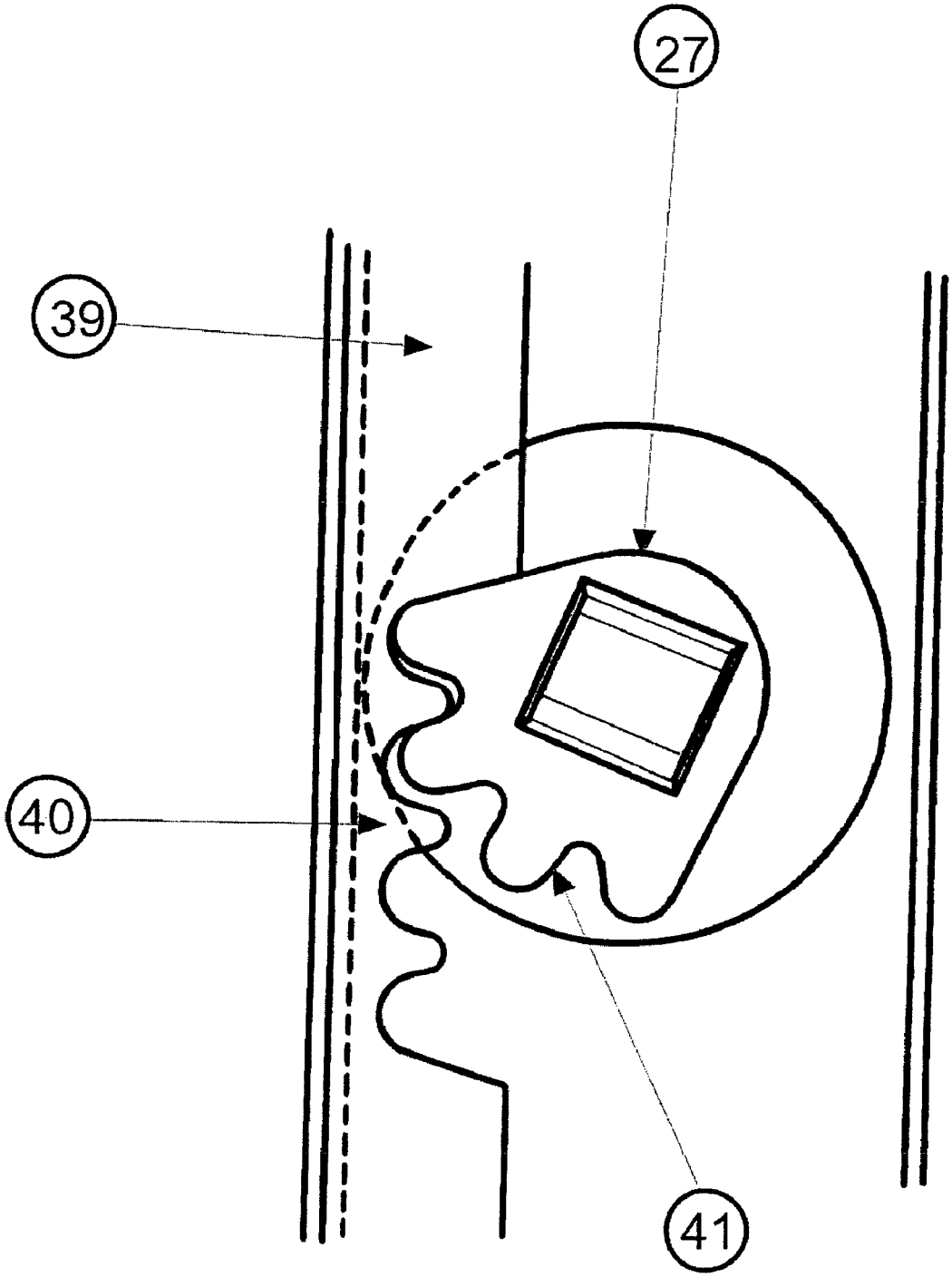
FIG. 7. illustrates in detailed elevation view of the portion identified in FIG. 12, of a sprocket tooth form punched into one leg of the L-shaped operating member and engaging with teeth on the bearing.
Figure 10:
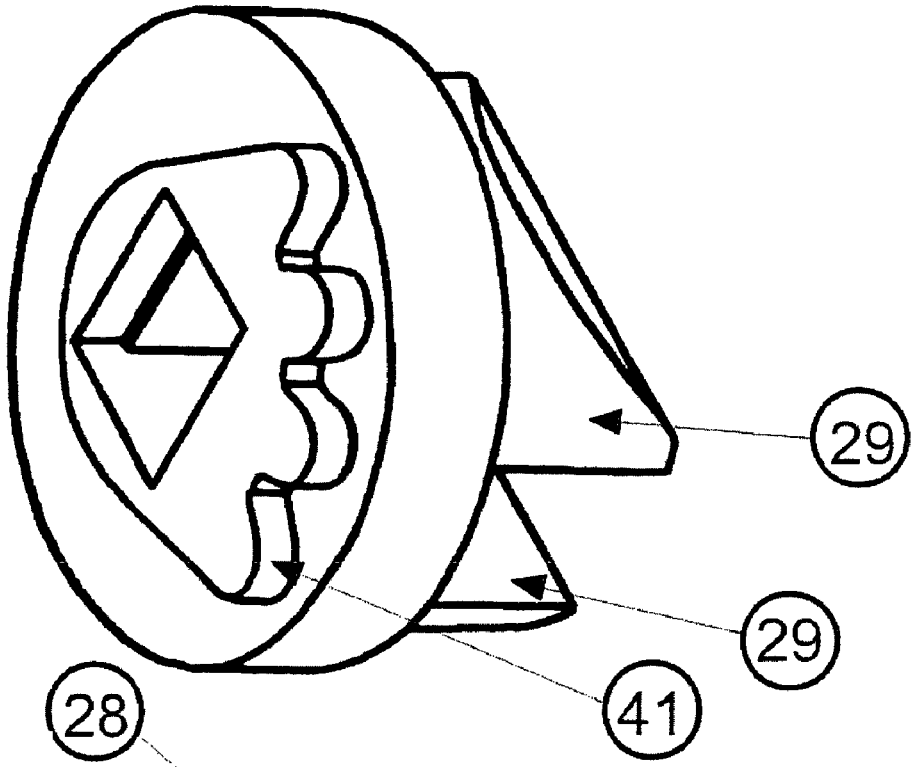
FIG. 10 illustrates a bearing of a preferred embodiment from one end.
Figure 11:
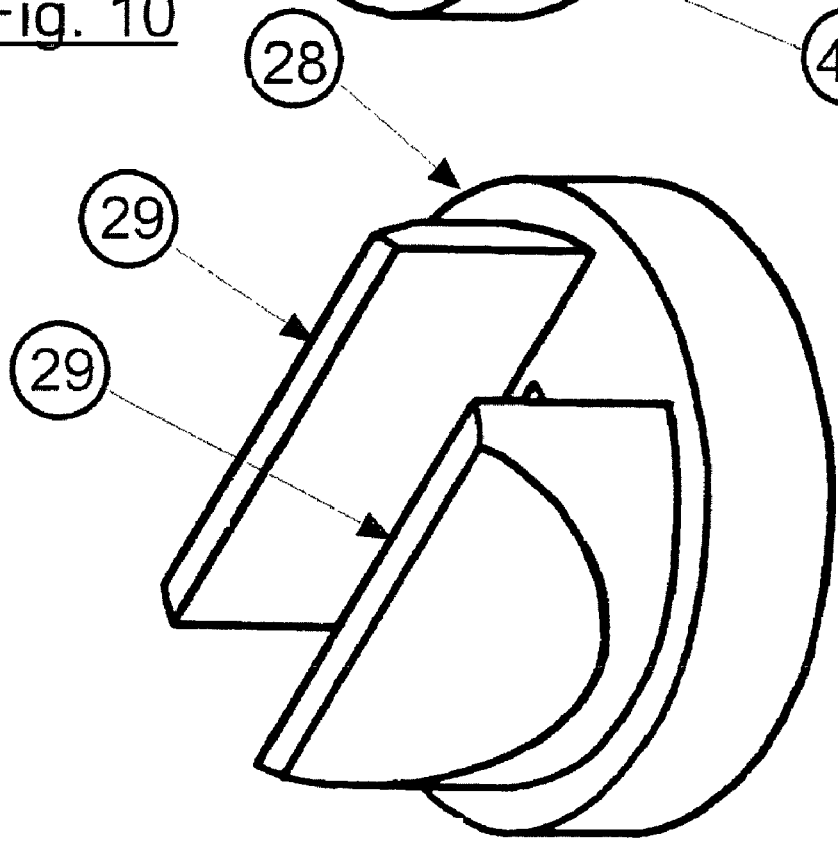
FIG. 11. Illustrates the bearing of FIG. 10 from the other end.

In the present invention, the end clips 10 are rotated by a bearing 27, bearing 27 being illustrated in FIGS. 3, 4 and 6 and being best illustrated in FIGS. 10 and 11 which shows the bearing by itself.

Bearing 27 has an outer wall 28 (see FIG. 11) fitted with a pair of opposed extending fingers 29. Fingers 29 extend to each side and grip the outer walls of recess 11 on end clip 10. This is best illustrated in FIGS. 3 and 4. Thus, rotation of bearing 27 causes rotation of the attached end clip. An opening (not illustrated) is provided in channel member 13 to allow the outer wall 28 and the fingers 29 of bearing 27 to project through the channel member and to engage with the outer walls of recess 11. It can also be seen from FIG. 3 that the fingers are positioned inside chambers 14 and 23.

Bearing 27 has an inner portion 30 which is positioned inside channel member 13 as illustrated in FIG. 3. The inner portion is provided with a camming portion 31 that comprises a resilient strip.

The inner wall of channel member 13 is provided with a camming surface 32.

The camming arrangement is such that when end clip 10 is in the closed position illustrated in FIG. 3, camming portion 31 is against camming surface 32 which functions to pull bearing 27 slightly into channel member 13 by a distance of between 1-3 mm. As bearing 27 is attached to end clip 10, end clip is also pulled against the outer wall 18 of channel member 13. Thus, when in the closed position, end clip 10 seals against the outer wall of channel member 13.

However, when the clip is slightly rotated by only a few degrees, camming portion 31 is rotated away from camming surface 32 (this being best illustrated in FIG. 4) that again allows the end clip to now not be pulled up against channel member 13.

Figure 5:
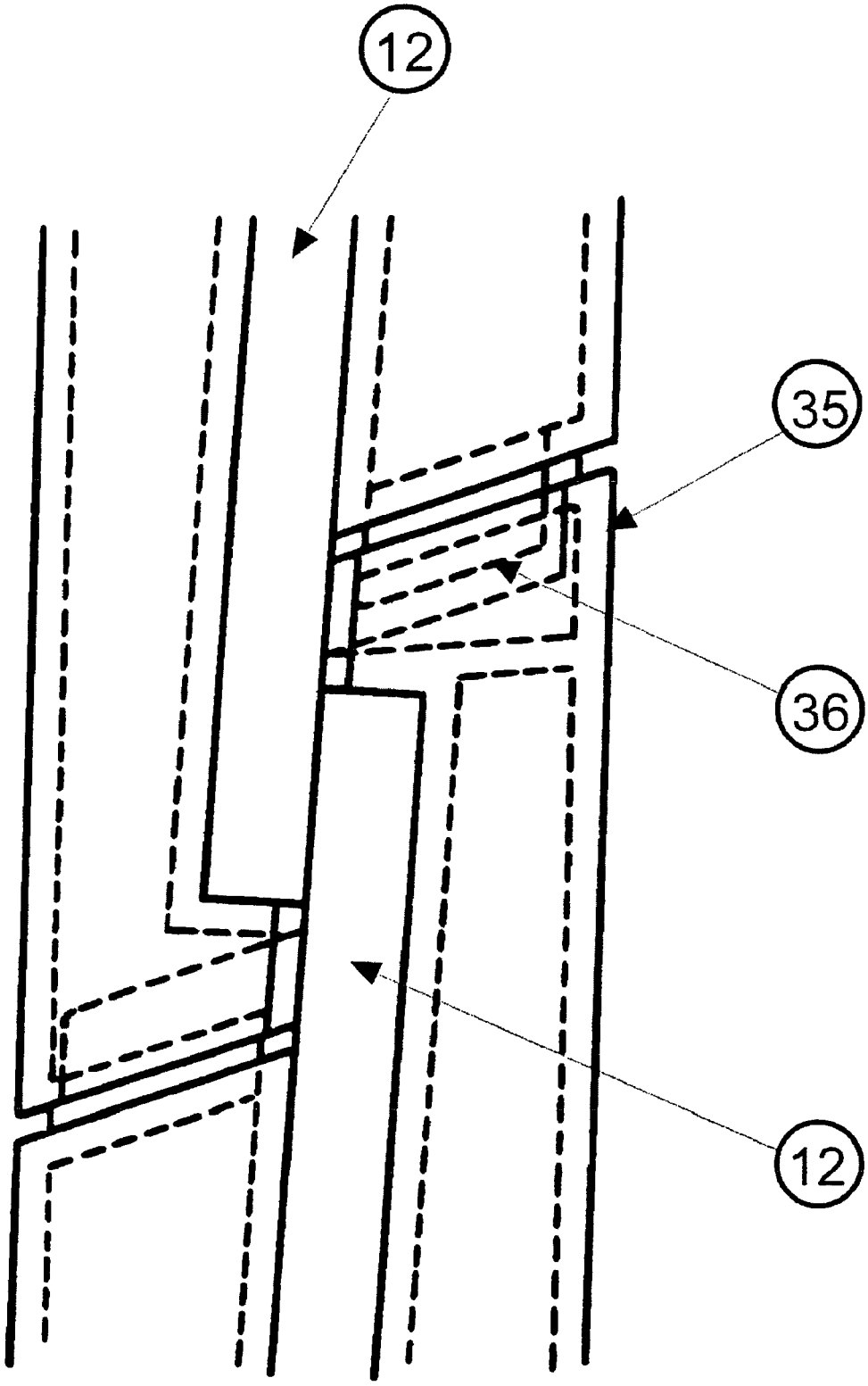
FIG. 5 illustrates a detailed view of a shroud showing internal walls of the louver end clips in dashed lines, a more general view of the shroud illustrated in FIG. 18.

Referring to FIG. 5 there is illustrated a shroud according to an embodiment of the invention. Shroud 35 covers the gap between adjacent clips. After much research and experimentation it has now been found that the efficiency of the shroud is maximised if the ratio between the gap width and the shroud length is between 5-6. Thus, if gap 36 is approximately 1 mm, the length of the shroud should be between 5 mm and 6 mm.

Figure 12:
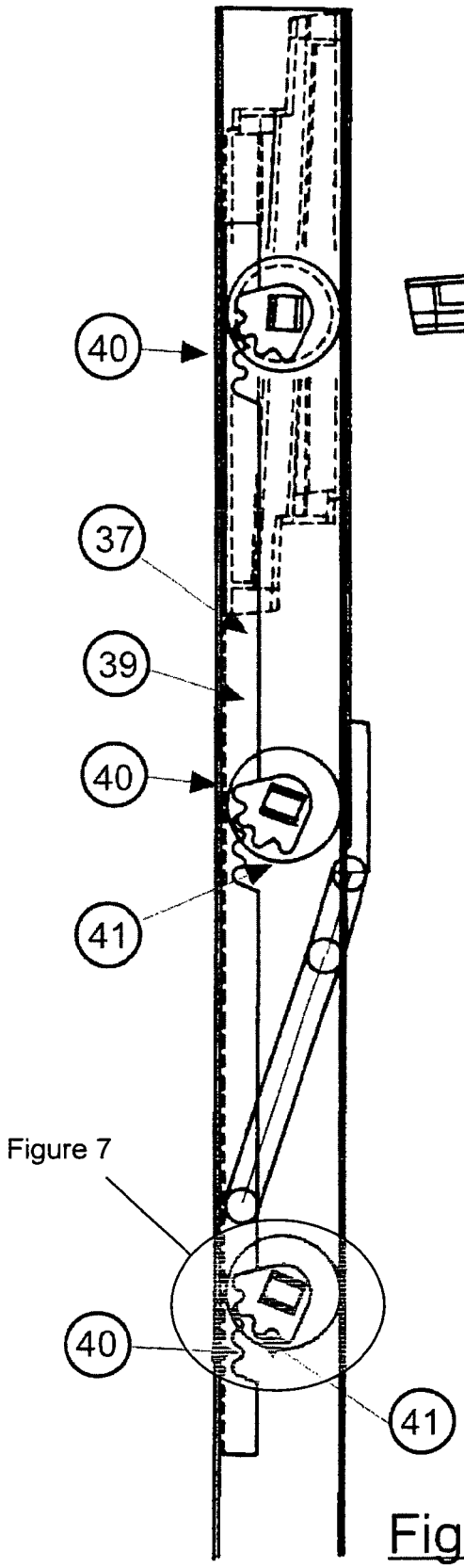
FIG. 12. illustrates the louvre operating assembly containing the L-shaped operating bar in the closed position from the direction of arrow C in FIG. 8 and with a first embodiment of handle added.
Figure 13:
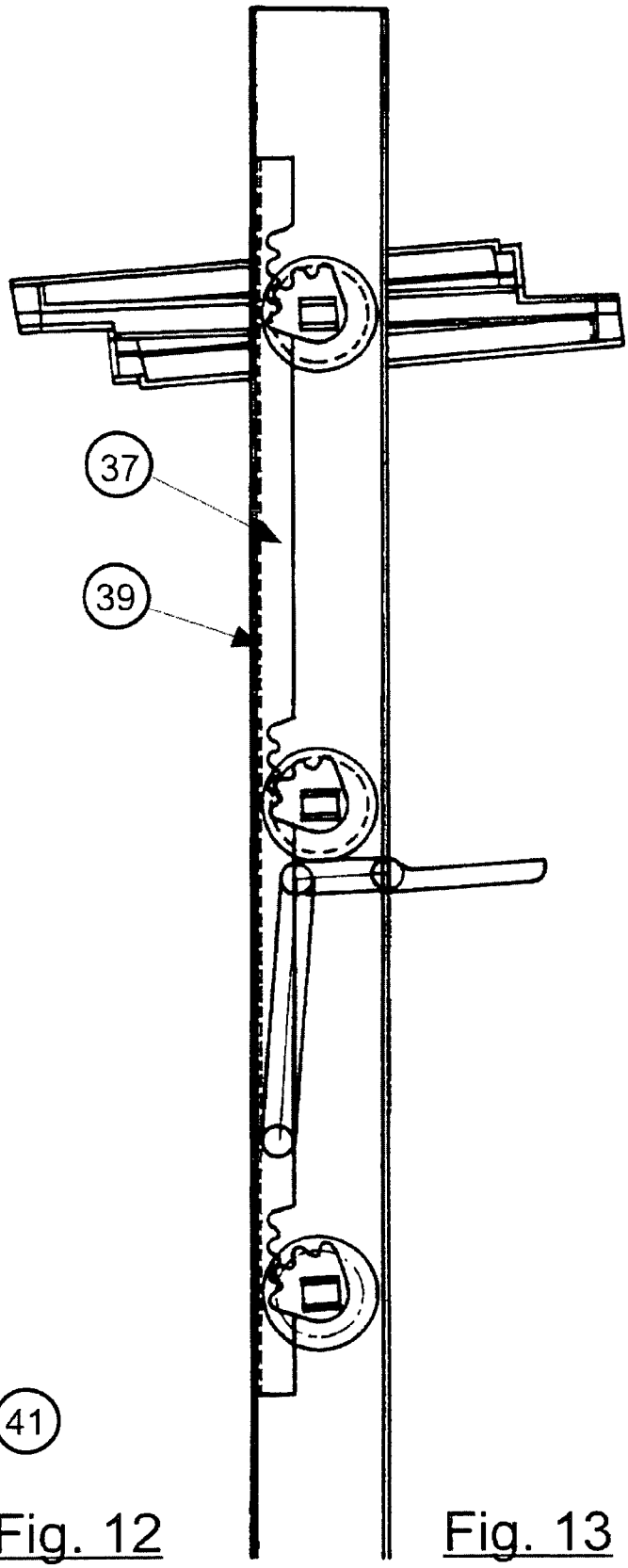
FIG. 13. Illustrates the louvre operating assembly of FIG. 12 in the open position.

FIGS. 6, 7, 12 and 13 illustrate parts of a louvre operating assembly according to an embodiment of the invention. The louvre operating assembly comprises a single L-shaped operating bar 37. The L-shaped operating bar means that the bar has two leg portions 38, 39 that are substantially at right angles to each other. The leg portion 39 is best illustrated in FIGS. 12 and 13 while the other leg portion 38 is best illustrated in FIG. 6. A sprocket tooth form 40 can be punched into leg portion 39 in a relatively simple operation. The pitching accuracy is easy to achieve and maintain as this is built into the punching tool. The other leg portion 38 is not punched, and provides strength to the operating bar.

Bearing 27 is a moulding and has matching teeth 41 moulded into the form.

Figure 14:
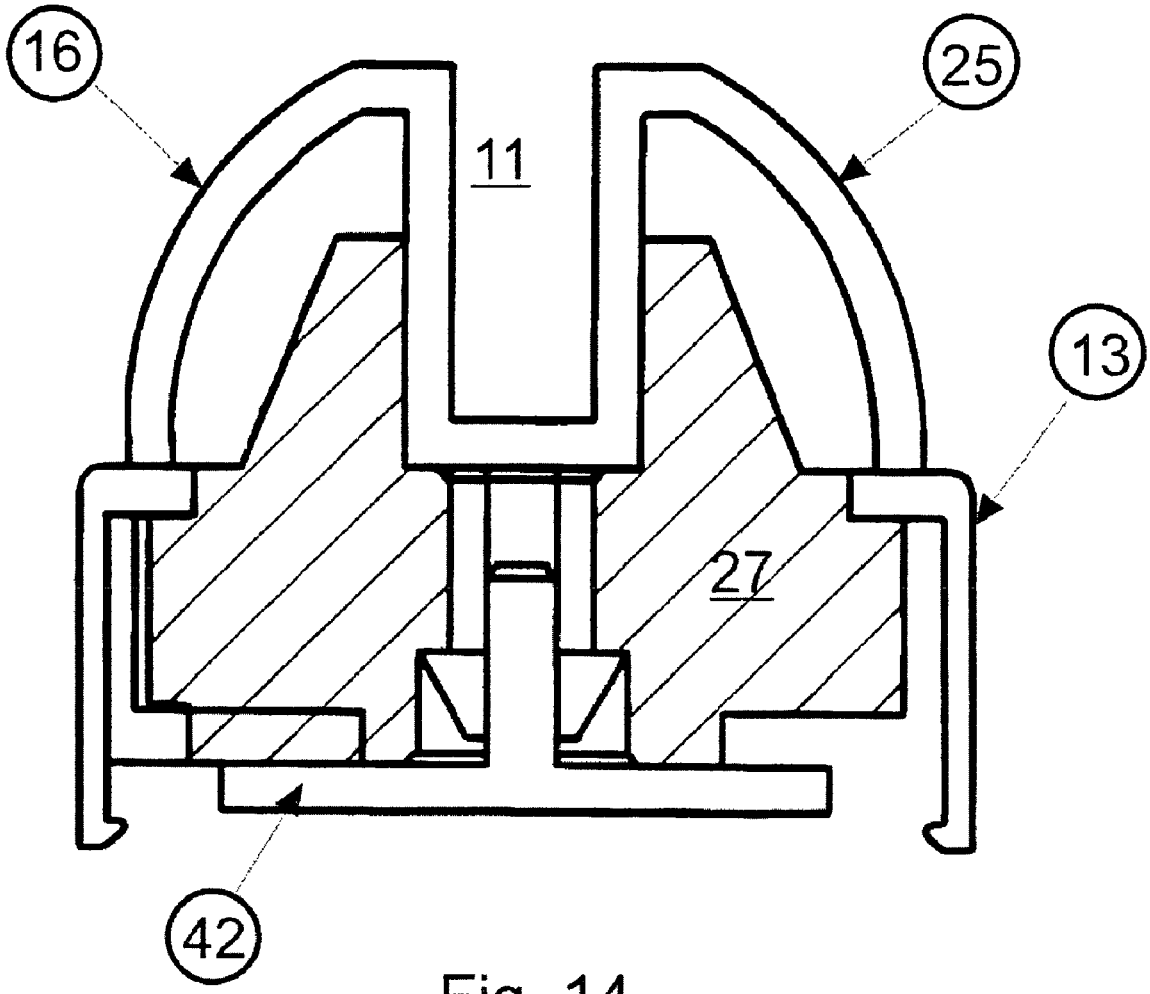
FIG. 14. illustrates a section view along line D-D illustrated in FIG. 18, of the bearing of a third embodiment containing a fitted end plate and attached to an end clip and positioned within the channel member.

Bearing 27 has a snap on cap 42 (see FIG. 6 and FIG. 14). The snap on cap traps leg member 39 between bearing 27 and the snap on cap 42. This is best illustrated in FIG. 6. Other leg member 38 is guided by the sidewall of channel member 13. This arrangement means that the forces between the operating bar and bearing 27 are shear forces, which maximises the strength of the components in the system.

The mechanism is also easier to assemble as the components are put together one on top of the other and in sequence. The sequence and ease of assembly lends itself to the development of an automatic assembly process.

The camming surface 32 in the embodiment comprises a centre rib. The centre rib also gives extra strength to the channel. In some installations the louvre assembly is screwed into the window frame through the centre of the channel. This has the tendency to deform the channel in the area where the screw is positioned with the result that the system fails the water penetration resistance requirements because of the gap caused by the defamation of the channel. The extra strength given by the rib assists in eliminating this problem.

Figure 15:
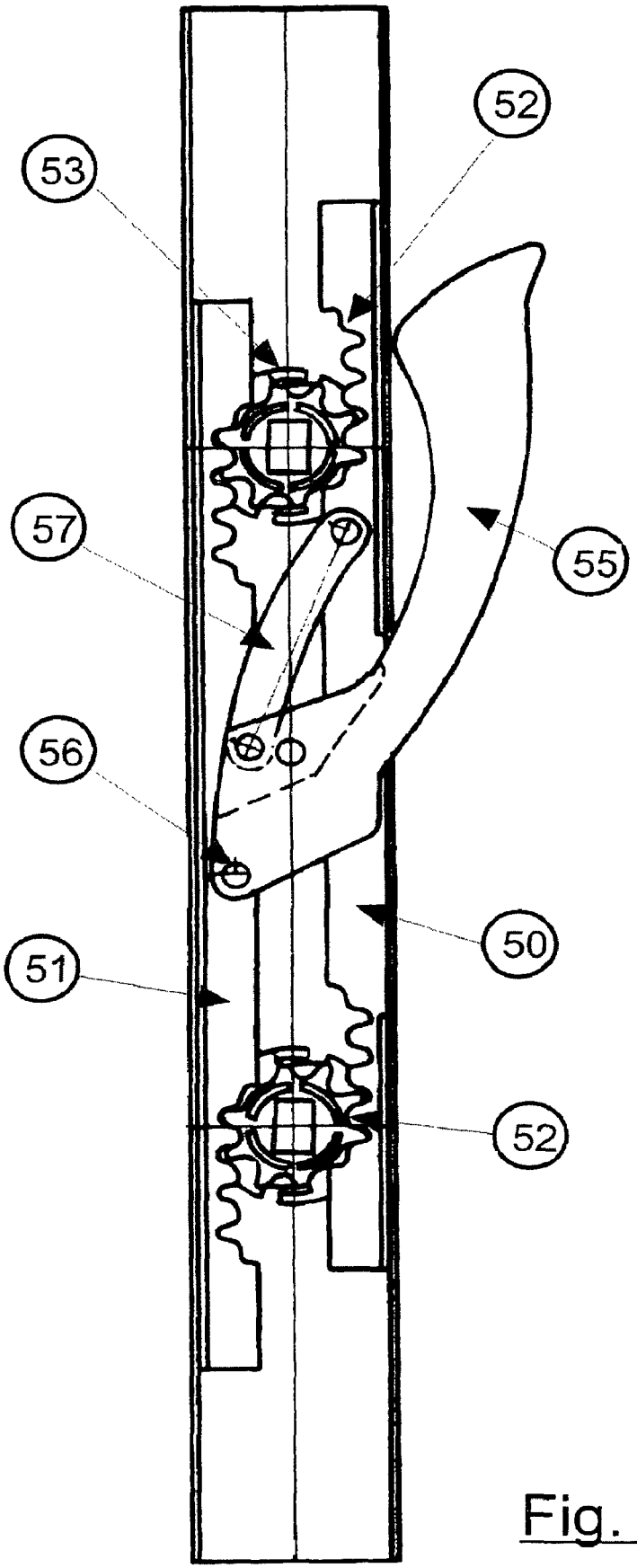
FIG. 15. illustrates an elevation view from the direction of arrow C in FIG. 8, of a slotted handle and dual operating bar mechanism in the closed position.
Figure 16:
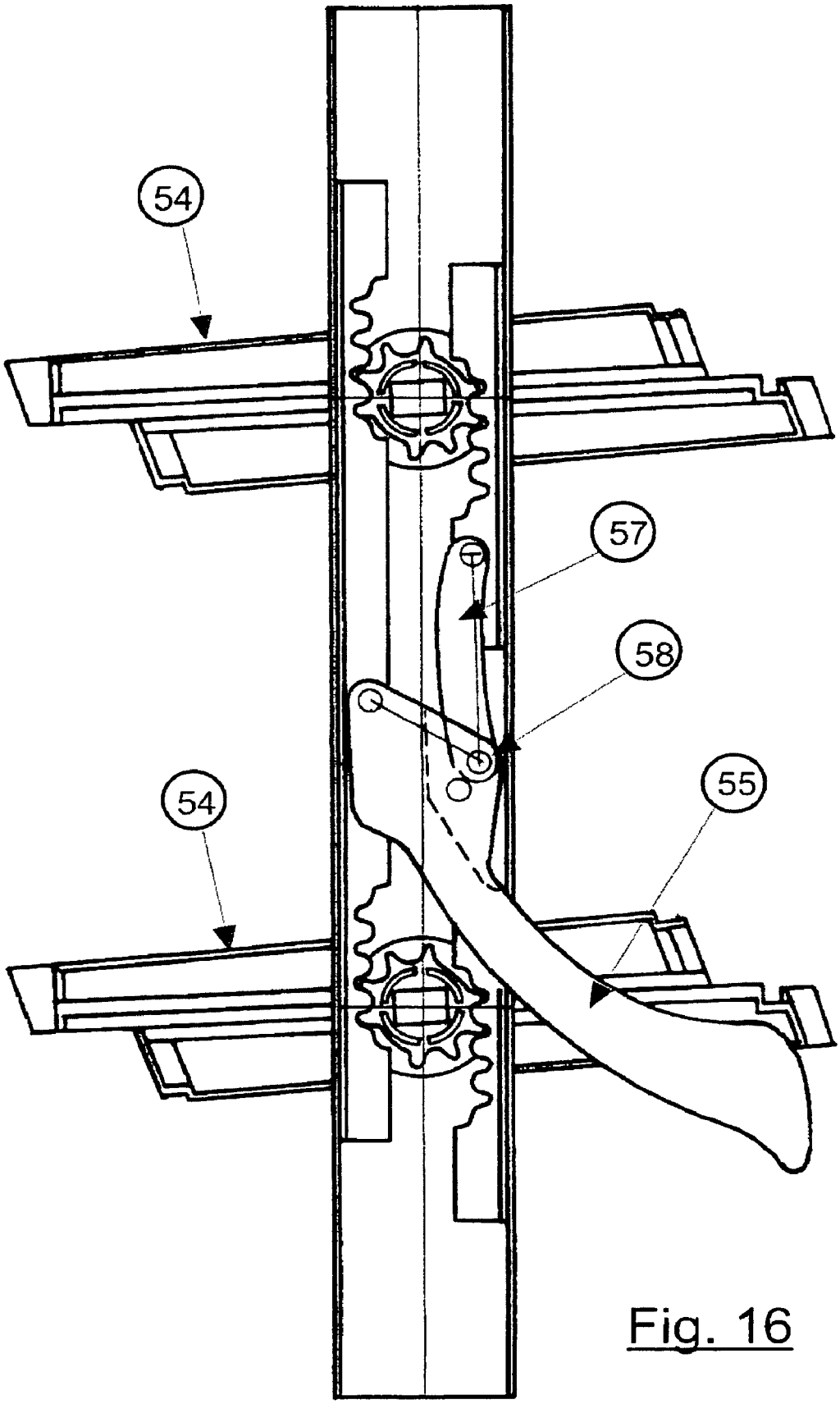
FIG. 16. illustrates an elevation view from the direction of arrow C in FIG. 8, of the slotted handle illustrated in FIG. 15, in the open position.
Figure 17A:
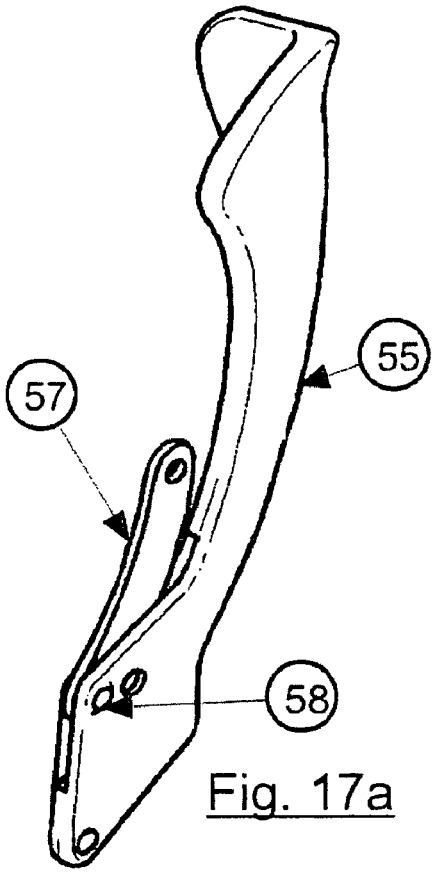
FIGS. 17A-17D. Illustrate various views of the slotted handle.
Figure 17B:
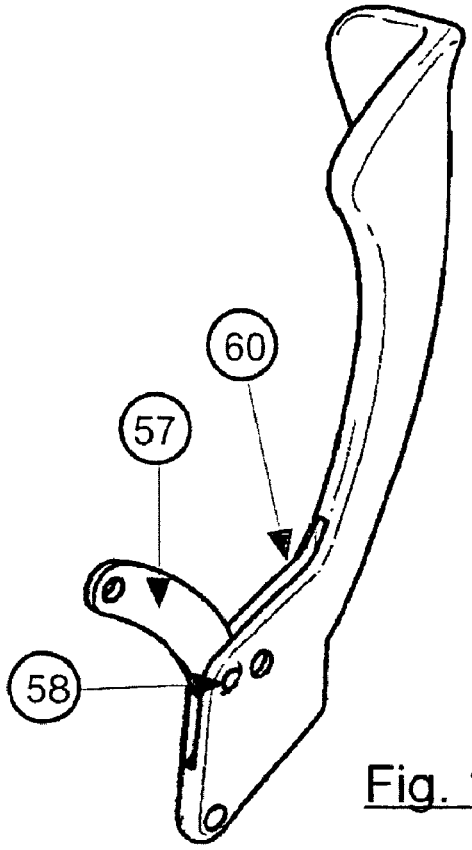
Figure 17C:
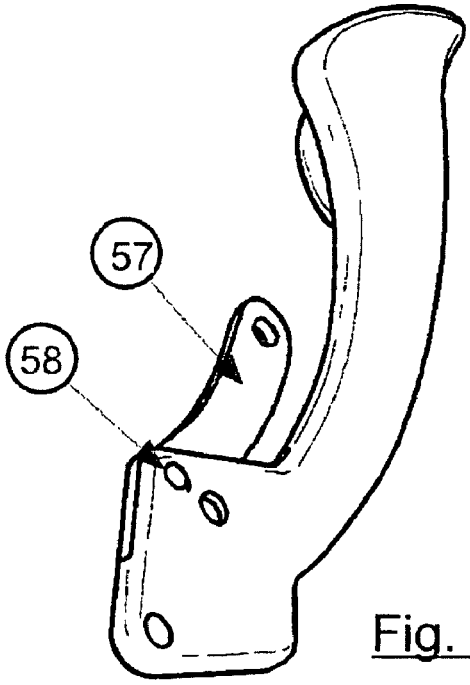
Figure 17D:
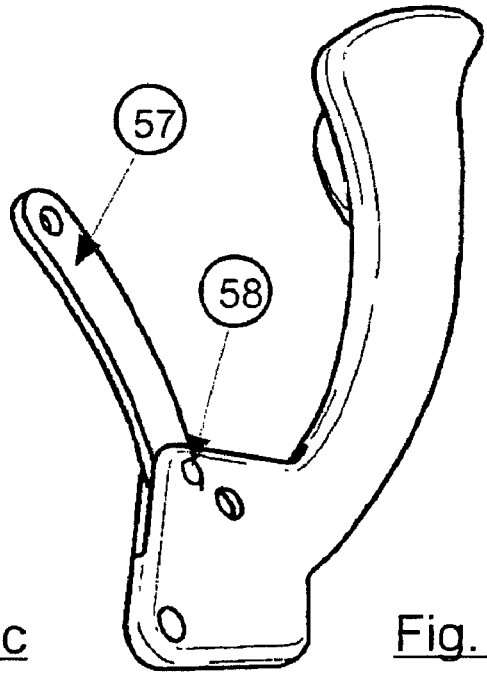
Figure 18:
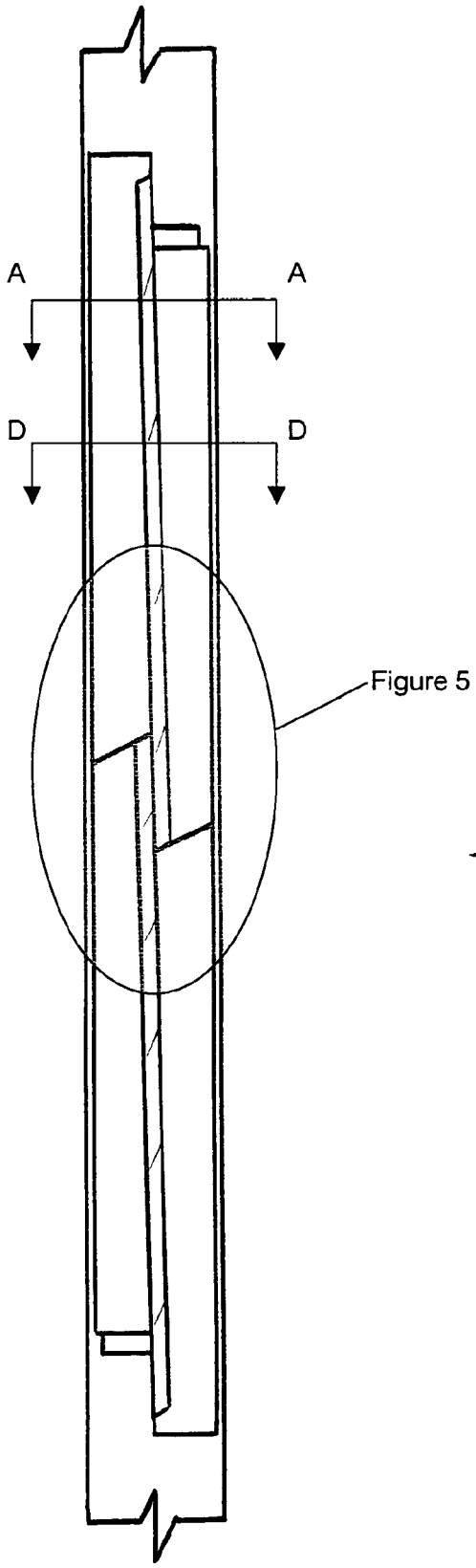
FIG. 18. illustrates an elevation view of a louvre assembly as illustrated in FIG. 8 from the direction of arrow B.
Figure 19:
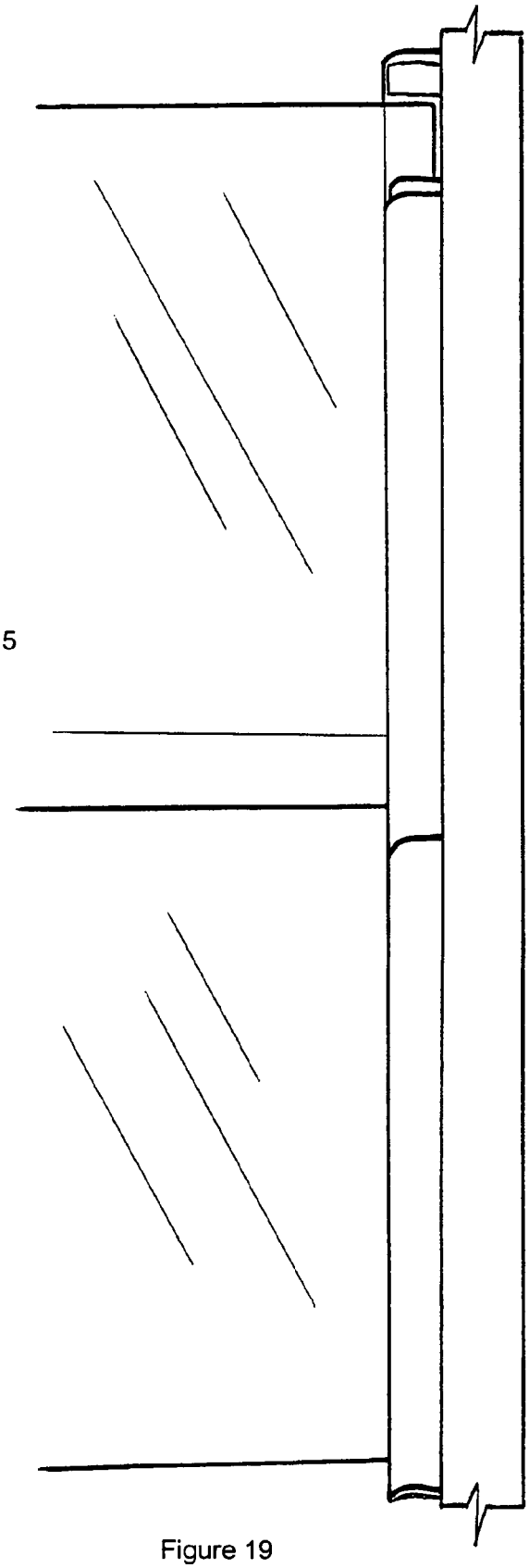
FIG. 19. illustrates a front elevation view of the louvre assembly illustrated in FIG. 8 from the direction of arrow F.

Referring to FIGS. 15-17 there is illustrated a particular slotted handle design to form part of the louvre operating mechanism. As illustrated in these particular figures, the louvre operating mechanism comprises a pair of slide members 50, 51. Each slide member is provided with a tooth profile 52 which engages with a gear 53. Gear 53 is part of the end clip 54 of a louvre. The slide members 50, 51 are operated by pulling handle 55 either up or down. In FIG. 15, handle 55 is in the up position and the louvres are closed, while in FIG. 16 handle 55 is in the down position and the louvres are open.

Handle 55 is pivotly mounted (typically via a rivet 56) to one of the slide members. Handle 55 is mounted to the other slide member via a link member 57 which is pivotly connected to the other slide member and to the handle 55. Link member 57 is pivotly connected to the handle via a pin 58. Referring now to FIGS. 17A-D, there is illustrated that handle 55 has a slot 60 and link member 57 can pivot partially into and out of slot 60. This enables pin 58 to be supported or fixed to both sides of the slot in the handle. This minimises any bending forces on the pin and increases the strength of this particular joint. There is reduced or no flexing of the joint under locking pressure as there is no component of the force at the joint which acts perpendicular to acting/reacting forces at the handle/link joint.

It should be appreciated that various changes and modifications may be made to the embodiment described without departing from the spirit and scope of the invention.

The invention claimed is:

1. A louver end clip, the end clip having (a) a pivotal body with a substantially planar base portion to be located adjacent a louver frame member and movable between an open and closed position;

(b) a longitudinal recess formed in the body and which is adapted to accommodate an edge of a louver blade, the longitudinal recess having a base wall and a pair of side walls, and (c) a pair of outer walls, a first outer wall extending from a side wall of the longitudinal recess outwardly away from the longitudinal recess and towards the planar base portion on an outer side of the louver blade and a second outer wall extending from a side wall of the longitudinal recess outwardly away from the longitudinal recess and towards the planar base portion on an inner side of the louver blade, the body having at least one internal drainage chamber between a side wall of the longitudinal recess and either the first or second outer wall which allows water to drain through the end clip when the end clip is in the closed position, wherein when a plurality of end clips are provided in the closed position, the drainage chamber on each end clip communicates to form a common drainage channel, and the first and second outer walls of adjacent louver end clips align to form a substantially continuous outer wall.

2. The clip of claim 1, wherein the at least one internal drainage chamber has an at least partially open top end and an at least partially open bottom end.

3. The clip of claim 2, wherein the at least one internal drainage chamber extends between the longitudinal recess which accommodates the louver blade, and an outer edge of the end clip.

4. The clip of claim 3, wherein the at least one internal drainage chamber has a curved outer wall.

5. The clip of claim 4, wherein a second drainage chamber is provided.

6. The clip of claim 5, wherein the longitudinal recess has a bottom wall, and the louver blade extends only partially into the longitudinal recess to define the second chamber between the bottom wall of the longitudinal recess of the louver end clip and an end edge of the louver blade.

7. The clip of claim 6, comprising a spacing means extending from the bottom wall to prevent the louver blade from passing entirely into the longitudinal recess.

8. The clip of claim 5, wherein a third drainage chamber is provided.

9. The clip of claim 8, wherein the clip comprises a weather side portion which is on a weather side of a louver window assembly to which the clip is attached, and comprises an inside portion which is on an inner side of the louver window assembly to which the clip is attached, the third drainage chamber being on the inside portion of the clip, and the first drainage portion being on the weather side of the clip.

10. The clip of claim 1, which comprises a weather side portion which is on a weather side of a louver window assembly and to which the clip is attached, and an inside portion which is on an inner side of the louver window assembly to which the clip is attached, the at least one internal drainage chamber being on the weather side portion, the clip having a third drainage chamber which is on the inside portion of the clip, and a second drainage chamber which is in the longitudinal recess, the weather side portion of the clip being curved and the inside portion of the clip being curved.

11. The clip of claim 1, in association with a support member to form a louver clip assembly, the at least one internal drainage chamber having an open bottom wall, the support member having a top wall, the top wall closing the open bottom wall of the internal drainage chamber when the clip is in the closed position.

12. The clip of claim 11, wherein the support member supports a plurality of spaced apart said louver clips, each clip being movable between an open position and a closed position, the clips being in alignment with each other when in the closed position, the internal drainage channel of an upper clip able to drain water into the internal drainage channel of a lower clip.

13. The clip of claim 1, pivotally attached to a support member to pivot the clip between a closed position where the clip is substantially in line with the member, and an open position where the end clip pivots to an angle relative to the member, and a bearing which is attached to the end clip such that rotation of the bearing causes the end clip to pivot, the bearing having a portion which is positioned in the support member, the portion being provided with a first camming member, the support member being provided with a camming surface, the position of the camming member and the camming surface being such that a seal is obtained only when the bearing member is rotated to the closed position, but when the bearing member is rotated to a partially louver open position, the seal is lost.

14. The clip of claim 1, in association with a louver operating system, the louver operating system comprising an elongate operating bar, the bar being substantially L-shaped to define 2 elongate legs which are substantially at right angles to each other, one leg being provided with a plurality of sprocket teeth spaced along the leg.

15. The clip of claim 14, further comprising a bearing which is attached to an end clip, the bearing being provided with a tooth profile which engages with the teeth on the operating bar such that reciprocation of the operating bar causes rotation of the bearing.

16. The clip of claim 14, wherein between 2-15 teeth are provided on a single operating bar.

17. The clip of claim 14, including a handle which operates the operating bar, the handle being connected via a joint to a link that is contained in a slot in the handle at the joint between the link and handle.

* * * * *